United States Patent [19]

Lewis

[11] Patent Number: 4,863,408

[45] Date of Patent: Sep. 5, 1989

[54] SLALOM SKI BINDINGS

[76] Inventor: Carl Lewis, 4215 Dellwood St., San Diego, Calif. 92111

[21] Appl. No.: 309,898

[22] Filed: Feb. 13, 1989

Related U.S. Application Data

[63] Continuation of Ser. No. 147,940, Jan. 25, 1988, abandoned.

[51] Int. Cl.[4] ..... A63C 15/06

[52] U.S. Cl. ..... 441/70

[58] Field of Search ..... 441/70; 280/607, 611, 280/623, 627, 633

[56] References Cited

U.S. PATENT DOCUMENTS

| | | | |
|---|---|---|---|
| 3,056,148 | 10/1962 | Abbott et al. | 9/310 |
| 3,119,130 | 1/1964 | Senne et al. | 9/310 |
| 3,121,891 | 2/1964 | Humason | 9/310 |
| 3,134,992 | 6/1964 | Tyll | 9/310 |
| 3,154,312 | 10/1964 | Marchand | 280/11.13 |
| 3,395,410 | 8/1968 | Rutland et al. | 441/70 |
| 4,028,760 | 6/1977 | Tarlton, Jr. | 9/310 A |
| 4,568,296 | 2/1986 | Newell | 441/70 |
| 4,673,365 | 6/1987 | Scheurer et al. | 441/70 |
| 4,674,765 | 6/1987 | Powell | 280/607 |

*Primary Examiner*—Sherman D. Basinger
*Assistant Examiner*—Stephen P. Avila
*Attorney, Agent, or Firm*—Calif K. Tervo

[57] ABSTRACT

A slalom ski includes bindings for retaining a skier's feet in an overlapping tandum disposition. A rear foot binding for retaining the skier's rear foot includes a vamp. The front foot binding for retaining a skier's front foot includes a vamp and a heel member. The heel member supports the skier's front foot heel above the rear foot vamp and restrains it from rearward and upward movement. In the preferred embodiment, the position of the bindings fore and aft on the ski is adjustable. Also, the relative position of the vamps and heel pieces are adjustable.

6 Claims, 1 Drawing Sheet

SLALOM SKI BINDINGS

This is a continuation of application Ser. No. 147,940 filed Jan. 25, 1988, now abandoned.

BACKGROUND OF THE INVENTION

1. Field of the Invention

This invention relates in general to ski foot bindings, and more particularly to a slalom ski foot binding.

2. Description of the Related Art

In slalom skiing only one ski is used to support the rider as differentiated from normal skiing in which two skis are used. The conventional slalom water ski includes tandum foot bindings attached to the ski: a binding for retaining the skier's front foot and a binding for retaining the skier's rear foot. At average or greater skiing speeds, the rear of the ski provides the greatest lift. Consequently, the slalom skier's rear leg supports by far the greater amount of his weight. Such disproportionate weight distribution causes the skier's rear leg to tire much more rapidly than the front leg.

Also, a slalom skier's rear leg is bent. This increases the difficulty in supporting the skier's weight.

Therefore it is desirable to have a ski binding that more evenly distributes the load to each of the skier's legs and that permits the skier's rear leg to be straighter, thus enabling it to more evenly carry the weight.

SUMMARY OF THE INVENTION

According to the invention, a slalom ski includes bindings for retaining a skier's feet in an overlapping tandum disposition. A rear foot binding for retaining the skier's rear foot includes a vamp. The front foot binding for retaining a skier's front foot includes a vamp and a heel member. The heel member supports the skier's front foot heel above the rear foot vamp and restrains it from rearward and upward movement. In the preferred embodiment, the position of the bindings fore and aft on the ski is adjustable so that the location of the center of gravity of the skier over the ski is adjustable. Also, the relative position of the vamps and heel pieces are adjustable.

Other features and many attendant advantages of the invention will become more apparent upon a reading of the following detailed description together with the drawings, in which like reference numerals refer to like parts throughout.

DETAILED DESCRIPTION OF THE INVENTION

Figure 1:
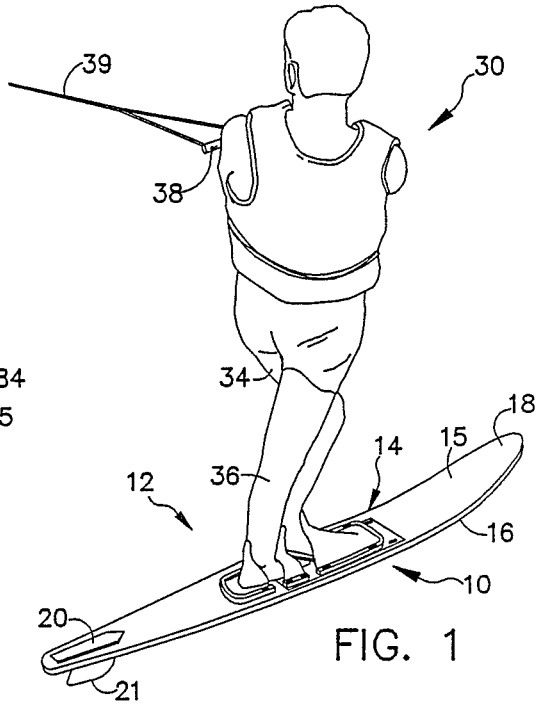
FIG. 1 is a perspective view of a skier riding on a water ski having the overlapping foot bindings of the present invention.

With reference now to the drawing, and more particularly to FIG. 1 thereof, there is shown a water skier 30 riding on a slalom ski, denoted generally as 12. Skier 30 grasps handles 38 on rope 39 which is attached to a vehicle, such as a boat (not shown), which pulls the skier.

The slalom ski 12 includes a body 14 having upper and lower surfaces 15,16, front end 18, and tail end 20. A rudder or fin 21 is attached to tail end 20. Bindings, denoted generally as 10, attached to ski 12, retain the skier's feet in a tandum relationship. Rear binding 50 retains the foot the skier's rear leg 36, and front binding 70 retains the foot of the skier's front leg 34.

Figure 2:
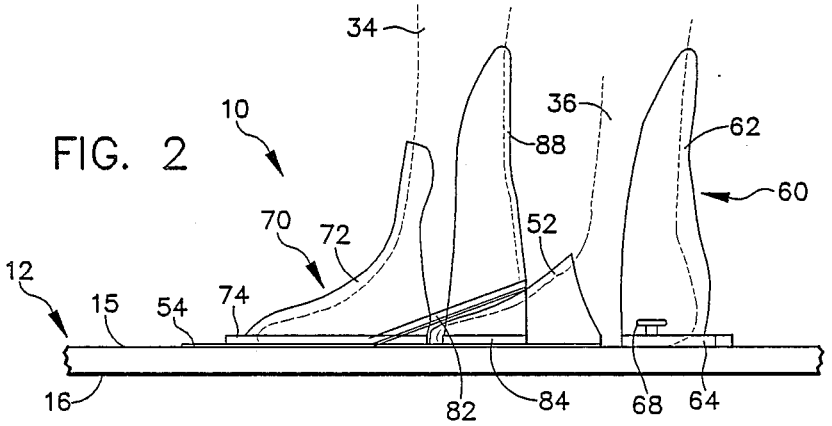
FIG. 2 is an enlarged side elevational view of the binding of FIG. 1.
Figure 3:
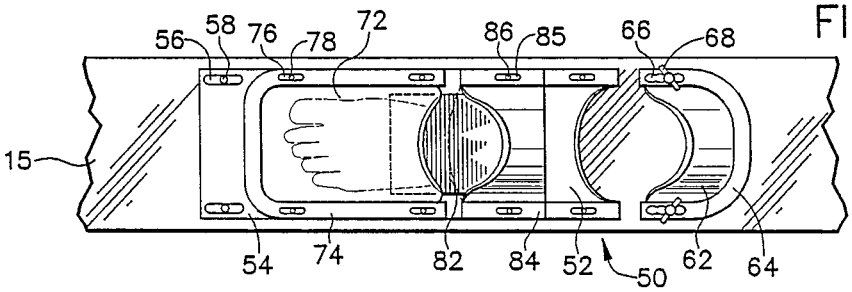
FIG. 3 is a top plan view of the binding of FIG. 2.

Bindings 10 are best seen and described with reference to FIGS. 2 and 3. FIG. 2 is an enlarged side elevational view of the bindings 10 of FIG. 1. FIG. 3 is a top plan view of the bindings 10 of FIG. 2. In these Figures, the members 72, 88, 52, 62, which contact and retain or restrain the skier's feet, are made of strong, flexible, and resilient material, such as neoprene and rubber. Rear foot binding 50 includes means, such as vamp 52, for retaining the front portion of the skier's rear foot, and may include means, such as heel piece 60, for retaining the heel of the rear foot.

Mounting means, such as plate 54, secures vamp 52 to ski 12 by any of several suitable means, such as screws 58. Plate 54 is U-shaped to the rear to secure the front and side edges of vamp 52, and to permit the front portion of the skier's rear foot to rest on ski upper surface 15. Adjustment means, such as slots 56 and screws 58 allow plate 54, and thereby vamp 52, to be moved fore and aft on the ski to adjust the position of the center of gravity of the skier with respect to the ski.

Rear foot heel piece 60 includes heel restraining member 62 and mounting means, such as U-shaped mounting clamp 64, for securing member 62 to the ski. Adjustment means, such as slot 66 and screw 68, allows fore and aft movement of heel piece 60 on the ski to correspond to movements of plate 54 or to accommodate various skier foot sizes.

Front binding 70 includes means, such as vamp 72, for retaining the front portion of the skier's front foot. Attachment means, such as U-shaped clamp 74, secures vamp 72. Clamp 74 is mounted on plate 54 by suitable means such as screws 78, so that it moves with the center of gravity adjustment of plate 54. Adjustment means, such as slots 76 accommodating screws 78 permit independent fore and aft placement of vamp 72.

Figure 4:
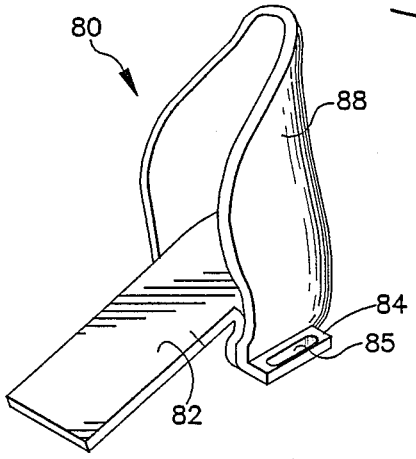
FIG. 4 is a perspective view of an exemplary embodiment of the heel portion of the front foot binding.

Heel portion 80 of the front binding includes heel support member means 82 for supporting the heel of the skier's front foot above the front portion of the skier's rear foot. With reference now to FIG. 4, there is shown an exemplary embodiment of the heel portion 80 of the present invention. Heel support 82 is an arched member crossing side to side over rear foot vamp 52. Heel support 82 may be constructed out of any suitable structural material, such as strong plastic, which will support the load of the skier. In the exemplary embodiment, heel portion 82 includes a ramp which extends down and forward and terminates adjacent the ski upper surface. Therefore it may support the entire rear portion of the skier's front foot. Clamp bars 84,84 secure heel portion 80 to plate 54. Adjustment means, such as slots 85 and screws 86, allow fore and aft positioning of heel portion 80. Heel retaining means, such as member 88, is attached to the remainder of heel portion 80 and retains the skier's heel.

Although a particular embodiment of the invention has been illustrated and described , various changes can be made in the form, construction, and arrangement of the parts herein without sacrificing any of its advantages. For example, heel restraining members 62,88 may be omitted. Therefore, it is to be understood that all matter herein is to be interpreted as illustrative and not in any limited sense, and it is intended to cover in the appended claims such modifications and changes as come within the true spirit and scope of the invention.

What I claim is:

1. In combination with a ski, said ski having generally co-planar upper and lower surfaces; foot binding means attached to said ski upper surface for retaining a skier's feet in tandum above said upper surface; said binding means comprising:

rear foot retaining means for retaining a skier's rear foot including:

a rear foot vamp; and front foot retaining means for retaining a skier's front foot including:

a front foot vamp; and heel support means for independently supporting, with the ski in a horizontal position, a skier's front foot heel directly above said rear foot vamp.

2. The ski binding of claim 1 wherein said heel support means includes:

a heel retaining means for preventing rearward movement of a supported heel.

3. The ski binding of claim 1 wherein said rear foot retaining means includes:

a heel restraint for preventing rearward movement of the rear foot heel.

4. The ski binding of claim 1 wherein said heel support means includes:

an arched member attached to said ski and passing directly over said rear foot vamp and having a heel support area.

5. The ski binding of claim 4 wherein said arched member includes:

a ramp portion extending forward and downward from said heel support area for supporting the center portion of a skier's front foot.

6. In combination with a ski, said ski having generally co-planar upper and lower surfaces; foot binding means attached to said ski upper surface for retaining a skier's feet in tandum above said upper surface; said binding means comprising:

rear foot retaining means for retaining a skier's rear foot including:

a rear foot vamp; and front foot retaining means for retaining a skier's front foot including:

a front foot vamp; and front foot heel support and restraining means for independently supporting, with the ski horizontal, a skier's front foot heel directly above said rear foot vamp and for restraining it from rearward and upward movement; and means for adjusting the relative fore and aft positioning of said rear foot vamp and said front foot vamp.

* * * * *